US006220213B1

(12) United States Patent
Haas et al.

(10) Patent No.: US 6,220,213 B1
(45) Date of Patent: Apr. 24, 2001

(54) ROCKER ARM INSTALLED IN A CYLINDER HEAD OF A VALVE TRAIN OF AN INTERNAL COMBUSTION ENGINE

(75) Inventors: Michael Haas, Weisendorf; Dieter Schmidt, Nürnberg; Walter Speil, Ingolstadt, all of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/535,020

(22) Filed: Mar. 24, 2000

(30) Foreign Application Priority Data

Mar. 27, 1999 (DE) ..... 199 14 044

(51) Int. Cl.[7] ..... F01L 1/18; F02D 13/02

(52) U.S. Cl. ..... 123/90.16; 123/90.41; 123/198 F

(58) Field of Search ..... 123/90.15, 90.16, 123/90.39, 90.41, 198 F

(56) References Cited

U.S. PATENT DOCUMENTS 5,893,344 * 4/1999 Church ..... 123/90.16

FOREIGN PATENT DOCUMENTS

| | | |
|---|---|---|
| 3313437 | 10/1983 | (DE) . |
| 3239941 | 5/1984 | (DE) . |
| 19604866 | 8/1997 | (DE) . |
| 19500575 | 7/1998 | (DE) . |
| 2068495 | 8/1981 | (GB) . |

* cited by examiner

*Primary Examiner*—Weilun Lo
(74) *Attorney, Agent, or Firm*—Bierman, Muserlian and Lucas

(57) ABSTRACT

A rocker arm (6) that can be uncoupled from the cam lift, the axle (11) of this rocker arm (6) is guided for longitudinal movement in a slot (12) of a pedestal (13), and the rocker arm (6) can be coupled to the pedestal (13) by locking elements (20, 21, 22) or it can be uncoupled from the pedestal (13) by these locking elements (20, 21, 22) for achieving a zero lift of an associated gas exchange valve (9).

11 Claims, 1 Drawing Sheet

ROCKER ARM INSTALLED IN A CYLINDER HEAD OF A VALVE TRAIN OF AN INTERNAL COMBUSTION ENGINE

FIELD OF THE INVENTION

The invention concerns a rocker arm installed in a cylinder head of a valve train of an internal combustion engine, said rocker arm comprising on a first end of an undersurface, a support for a cam-actuated push rod, on a second end of the undersurface, a contact surface for at least one gas exchange valve, and between the first and second ends, a cross-bore through which the rocker arm is pivoted on an axle, the rocker arm can be uncoupled in a region of the axle at least partially from a pivoting movement in a region of the contact surface when the rocker arm is subjected to a tilt loading by the push rod.

BACKGROUND OF THE INVENTION

In a rocker arm of the pre-cited type known form DE-A 33 13 437, the axle is connected to a clearance compensation element. A slide connected to a solenoid acts on the one-way valve of the clearance compensation element in opening direction, i.e. in a direction toward a high pressure chamber. During a positive loading of the one-way valve by the slide when the solenoid is active, the hydraulically maintained rigidity of the high pressure chamber is neutralized. Upon a lifting motion of the cam, the axle of the rocker arm can now be displaced toward the solenoid so that the rocker arm pivots about its contact surface on the gas exchange valve which thus remains closed.

A drawback of this prior art rocker arm is that it is supported by hydraulic means so that it possesses a certain degree of undesired elasticity in support direction in the region of its axle. It must be remarked further that the uncoupling unit comprising the solenoid and the slide is a mechanism of a relatively complicated structure and is expensive to manufacture.

OBJECTS OF THE INVENTION

It is an object of the invention to provide a rocker arm of the pre-cited type which eliminates the above-mentioned drawbacks.

This and other objects and advantages of the invention will become obvious from the following detailed description.

SUMMARY OF THE INVENTION

The invention achieves the above objects by the fact that the axle is guided in a slot of a pedestal fixed at least indirectly on the cylinder head, said slot extending in a direction toward the cylinder head, each of the axle and the pedestal comprising at least one reception for a total of at least one locking element, for uncoupling the pivoting movement, said locking element extends entirely in one of the receptions and for coupling the pivoting movement, the locking element can be partly displaced into the other of the receptions which is situated opposite thereto.

The measures proposed by the invention create a simple mechanism by which the rocker arm can be uncoupled at its end comprising the contact surface for the gas exchange valve at least partly, but preferably completely, from the lifting movement of the cam which actuates the push rod. The coupling means can be configured as at least one slide, but in a preferred embodiment, the coupling means comprises three slides.

The stop proposed by the invention for the axle on the cylinder head-proximate end of the slot creates an exact definition of the position of the receptions for the locking elements (slides) in the base circle phase of the actuating cam.

According to a further proposition of the invention, a spring means acts on the axle in valve direction. In the run-off phase of the cam, this spring means effects in a simple manner, a re-displacement of the axle together with the rocker arm out of the uncoupled state. In this way, the rocker arm is maintained together with the push rod in permanent contact with the cam (lost motion effect).

Advantageously, the spring means is installed in the slot and is supported at one end on this slot and at the other end, on a top surface of the axle.

Although it is conceivable to arrange the receptions for the coupling of the axle to the pedestal at an inclined position relative to the rocker arm, it is preferred to have these receptions extend in the longitudinal direction of the rocker arm. The scope of the invention also extends to a locking element in the form of one single slide but it is preferable to arrange a slide in each reception, in which case, the slide in the axle extends, in the uncoupled state, over the entire length of its reception.

In a preferred embodiment of the invention, the entire assembly of slides is displaced in at least one direction of displacement, for instance, in the uncoupling direction, by hydraulic medium pressure. In the other direction (coupling direction), the slide assembly may be displaced by the force of a spring means such as at least one compression spring. Thus, in the absence of hydraulic medium pressure, for instance when the engine has just been started, the rocker arm is in a coupled state and the gas exchange valve concerned can open.

According to still another feature of the invention, the servo medium is routed to an end face of one or both of the outer slides through at least one channel for each slide arranged in the pedestal and communicating with a supply in the cylinder head. Another possibility is to route the hydraulic medium to the respective slide through a duct extending along the axle.

The compression spring proposed as a displacing means for the slides may be replaced with an electromagnetic, magnetic or other similar means.

According to a final proposition of the invention, the two ends of the axle may project out of the rocker arm and each end may be guided in a slot of a separate pedestal.

The invention will now be described more closely with reference to the appended drawings.

DETAILED DESCRIPTION OF THE DRAWINGS

Figure 1:
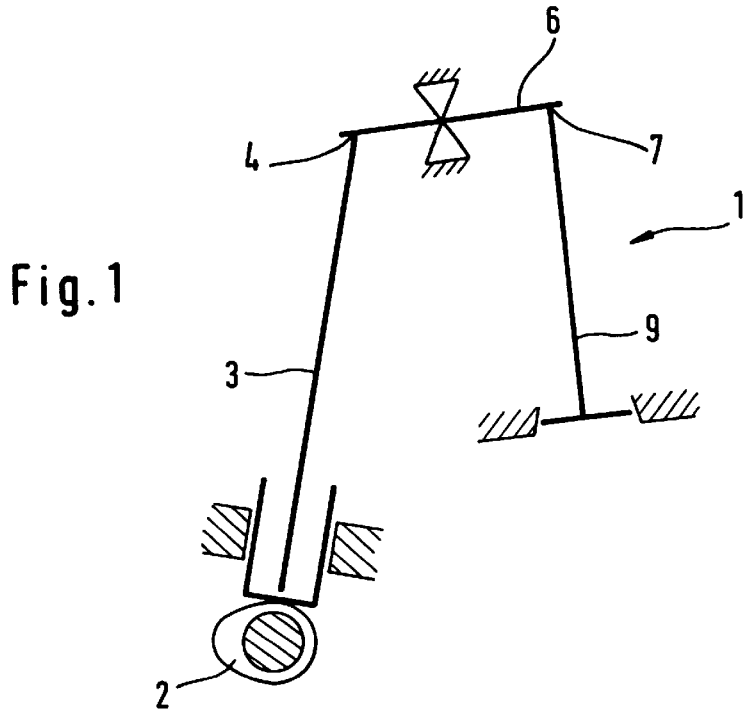
FIG. 1 is a schematic representation of a valve drive having a rocker arm and an actuating push rod.

FIG. 1 shows a valve drive 1 in a schematic representation. This valve drive 1 comprises a cam 2 which actuates a push rod 3. The push rod 3 acts on an end 4 of an undersurface 5 of a rocker arm 6. Another end 7 of the rocker arm 6 comprises a contact surface 8 for acting on a gas exchange valve 9 (see also FIG. 2).

Between the two ends 4, 7, preferably in the region of its central transverse plane, the rocker arm 6 comprises a cross-bore 10. Through this cross-bore 10, the rocker arm 6 is pivoted on an axle 11. The axle 11 is guided at both its ends within a slot 12 of a pedestal 13 that is fixed on a cylinder head (not shown). A top surface 14 of the axle 11 is arranged at a distance from a cylinder head-distal end 15 of the slot 12. A spring means 16 (in the present embodiment, a compression spring) is constrained within the slot 12 between the end 15 of the slot 12 and the top surface 14 of the axle 11.

Figure 2:
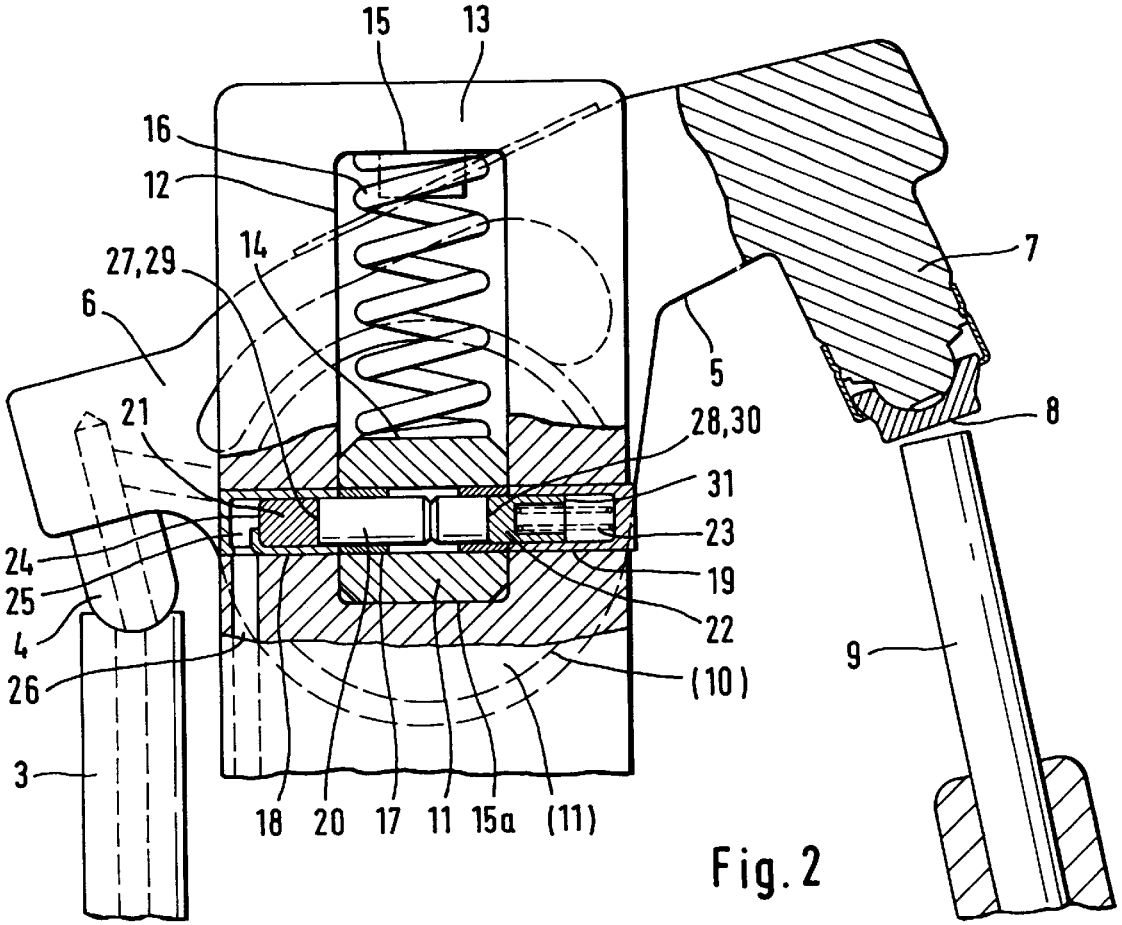
FIG. 2 is a cross-sectional view of the rocker arm.

FIG. 2 further discloses that the axle 11 comprises a reception 17 extending in lever direction. In the present case, the reception 17 is a through-bore. Two further receptions 18, 19 arranged in opposing sections of the pedestal 13 are aligned to the reception 17. A locking element 20, 21, 22, configured in the present case as a piston-like slide, extends in each of the receptions 17, 18, 19. The length of the locking element 20 is equal to the length of its reception 17. The locking element 22 arranged in the pedestal 13 is urged toward the locking element 20 by the force of a spring means 23 which, in the present case, is a compression spring. A pressure chamber 25 is arranged in front of an end face 24 of the other locking element 21. Hydraulic medium can be conducted into this pressure chamber 25 for displacing the entire assembly comprising the slides 20, 21, 22. For this purpose, the pressure chamber 25 communicates with a channel 26 extending through the pedestal 13. Hydraulic medium is fed into the channel 26 from a supply in the cylinder head (not shown).

As can also be seen in FIG. 2, the inner end faces 29, 30 of the locking elements 21, 22 are in permanent contact with the outer end faces 27, 28 of the locking element 20.

The rocker arm 6 is shown in FIG. 2 in its coupled state. Due to the coupling of the axle 11 to the pedestal 13 at a cylinder head-proximate end of the slot 12, the lifting motion imparted to the push rod 3 by the cam 2 is transmitted by the rocker arm 6 in a known manner to the gas exchange valve 9. If the said lifting motion of the cam 2 is to be uncoupled, the pressure of the hydraulic medium in the channel 26 is raised during the base circle phase of the cam 2 so that the locking elements 20, 21, 22 are displaced toward the reception 19. This process is ended when the end faces 27, 28, 29 extend directly at the slot 12. At the beginning of cam lift, the rocker arm 6 is displaced, against the force of the spring means 16, about its pivot point which is now situated in the region of the contact surface 8. During this time, the axle 11 executes an axially upward movement in the slot 12. The gas exchange valve 9 thus remains closed.

If a renewed transmission of the lifting motion of the cam 2 to the gas exchange valve 9 is desired, the pressure of the hydraulic medium in the channel 26, and thus also in front of the outer end face 24, is reduced during a base circle phase of the cam 2 during which the axle is in the position shown in FIG. 2, so that the entire assembly comprising the locking elements 20, 21, 22 is displaced toward the pressure chamber 25 by the force of the spring means 23. When the position shown in FIG. 2 is attained, the desired coupling of the axle 11 to the pedestal 13 is accomplished. The rocker arm 6 now follows the lift of the cam 2 in the usual manner and transmits this lift to the gas exchange valve 9.

In the uncoupled state of the axle 11, the spring means 16 assures a permanent support of the rocker arm 6 and the push rod 3 on the actuating cam 2 particularly in the run-off phase of the cam. At the same time, this assures the alignment of the receptions 17, 18, 19 required for the coupling function of the locking elements 20, 21, 22.

What is claimed is:

1. A rocker arm installed in a cylinder head of a valve train of an internal combustion engine, said rocker arm comprising on a first end of an undersurface, a support for a cam-actuated push rod, on a second end of the undersurface, a contact surface for at least one gas exchange valve, and between the first and second ends, a cross-bore through which the rocker arm is pivoted on an axle, the rocker arm can be uncoupled in a region of the axle from a pivoting movement in a region of the axle when the rocker arm is subjected to a tilt loading by the push rod thus deactivating the valve, the axle is guided in a slot of a pedestal fixed on the cylinder head, said slot extending in a direction toward the cylinder head, each of the axle and the pedestal comprises at least one reception for at least one respective locking element, wherein, for uncoupling the pivoting movement, said locking element extends entirely in one of the receptions, and wherein for uncoupling the pivoting movement, the locking element is displaced into the the receptions of the axle and the pedestal.

2. A rocker arm of claim 1 wherein the slot forms a cylinder head-proximate stop on one end for the axle, the receptions are aligned to one another in an end position of the axle, so that, for coupling the pivoting movement, the locking element can be partly displaced into the reception which is situated opposite thereto, and a length of the slot starting from the stop and extending in a direction away from the cylinder head is correlated with a desired height of an uncoupling of the pivoting movement.

3. A rocker arm of claim 1 wherein the receptions extend in longitudinal direction of the rocker arm, the pedestal comprises two aligned receptions, the locking elements are three slides, one of which extends in each of the receptions in an uncoupled state, the slide arranged in the axle extends over an entire length of the reception in which it is arranged, and inner end faces of the slides of the pedestal are situated directly adjacent to the slot in the uncoupled state.

4. A rocker arm of claim 3 wherein the locking elements can be displaced in an uncoupling direction by a servo medium, and in a coupling direction, the locking elements can likewise be displaced by the servo medium or by a force of a mechanical spring means, the servo medium can be routed to an outer end face of one of the slides in the pedestal while the other slide in the pedestal can be loaded on an outer end face likewise by the servo medium or by the spring means.

5. A rocker arm of claim 4 wherein the servo medium is a hydraulic medium.

6. A rocker arm of claim 4 wherein the spring means is at least one compression spring.

7. A rocker arm of claim 4 wherein a supply of the servo medium to the outer end face of at least one of the slides is realized through at least one channel in the pedestal, which channel communicates with a supply in the cylinder head.

8. A rocker arm of claim 1 wherein the axle is loaded in a direction toward the cylinder head by a spring means.

9. A rocker arm of claim 8 wherein the spring means is at least one compression spring.

10. A rocker arm of claim 9 wherein the compression spring is installed in the slot and acts at one end on a top surface of the axle and at another end, on a cylinder head-distal end of the slot.

11. A rocker arm of claim 1 wherein the axle is guided between two pedestals.

* * * * *